United States Patent [19]

Altamore

[11] Patent Number: 4,866,248

[45] Date of Patent: Sep. 12, 1989

[54] HAIR CURLING IRON FOR PROVIDING THREE-DIMENSIONAL Z-SHAPED CURLS

[75] Inventor: Nicolo Altamore, Rockford, Ill.

[73] Assignee: Wahl Clipper Corporation, Sterling, Ill.

[21] Appl. No.: 51,944

[22] Filed: May 19, 1987

[51] Int. Cl.[4] ..... A45D 1/04; A45D 2/12; H05B 3/00

[52] U.S. Cl. ..... 219/225; 132/229; 132/232; 219/230

[58] Field of Search ..... 219/222–226, 219/230; 132/34 C, 31 R, 31 A, 32 R, 32 A, 7, 9, 11 R, 34 R, 34 A, 34 B, 37 R, 37 A, 227, 229, 231, 223, 226, 231, 232

[56] References Cited

U.S. PATENT DOCUMENTS

| | | | |
|---|---|---|---|
| D. 253,254 | 10/1979 | Cusenza | D28/35 |
| D. 256,169 | 7/1980 | Cusenza | D28/35 |
| D. 281,823 | 12/1985 | Sherman . | |
| 364,956 | 6/1887 | Posner . | |
| 379,443 | 3/1888 | Bissell . | |
| 459,146 | 9/1891 | Nicol, Jr. . | |
| 536,802 | 4/1895 | Harris . | |
| 542,216 | 7/1895 | Allen . | |
| 681,827 | 9/1901 | Jackson | 132/40 |
| 861,596 | 7/1907 | Machado . | |
| 866,778 | 9/1907 | Eldridge . | |
| 1,056,987 | 3/1913 | Gough . | |
| 1,117,021 | 11/1914 | Frey | 132/37 R |
| 1,377,655 | 5/1921 | Begas . | |
| 1,397,332 | 11/1921 | Russell . | |
| 1,403,512 | 1/1922 | Mariner | 132/33 R |
| 1,455,696 | 5/1923 | Wright . | |
| 1,491,415 | 4/1924 | Pegelow . | |
| 1,510,359 | 9/1924 | Van Gale . | |
| 1,553,342 | 9/1925 | Vaughan . | |

(List continued on next page.)

FOREIGN PATENT DOCUMENTS

| | | | |
|---|---|---|---|
| D38998 | 3/1975 | Canada . | |
| D40144 | 1/1976 | Canada . | |
| D48414 | 7/1981 | Canada . | |
| D48415 | 7/1981 | Canada . | |
| 21941 | 1/1981 | European Pat. Off. | 219/225 |
| 185989 | 3/1906 | Fed. Rep. of Germany | 219/222 |
| 589572 | 2/1925 | France . | |
| 1005438 | 12/1951 | France | 132/37 R |
| 1368924 | 6/1964 | France | 132/42 R |
| 1379083 | 10/1964 | France | 219/225 |
| 2513497 | 4/1983 | France | 219/225 |
| 233070 | 2/1986 | German Democratic Rep. | 219/225 |
| 225941 | 12/1924 | United Kingdom | 132/42 R |
| 697773 | 9/1953 | United Kingdom | 132/42 R |

OTHER PUBLICATIONS

*Modern Salon*, "Special Pointers for Party Pizazz", Dec. 1977, p. 58.

*Primary Examiner*—Anthony Bartis
*Attorney, Agent, or Firm*—Welsh & Katz, Ltd.

[57] ABSTRACT

A hair curling apparatus includes a single elongated thermally conductive heating mandrel secured to the end of an elongated handle in axial alignment therewith and having two wide similar opposing surfaces joined by two narrow convex opposing surfaces with a radius of about 0.09 inch. The mandrel as of such length that hair strands may be helically wrapped therearound in a plurality of turns and a spring-biased manually operable hair clamp is pivotally mounted at the handle end of the mandrel for clamping the ends of the hair strands against the mandrel before they are helically wrapped therearound. The mandrel may have a generally oval or flattened shape. The clamp has a clamping surface which extends across a portion of one of the wide surfaces while exposing substantially all of the convex surfaces to direct contact with the hair strands and extends less than about 50 percent, and preferably about 30 percent, of the usable length of the mandrel. The hair strands are wound helically around the mandrel without twisting and without overlapping the turns to create three-dimensional Z-shaped curls having a plurality of straight lengths joined by sharp curves.

6 Claims, 4 Drawing Sheets

U.S. PATENT DOCUMENTS

| | | | |
|---|---|---|---|
| 1,580,370 | 4/1926 | Domdamville et al. | 132/32 R |
| 1,607,076 | 11/1926 | Hamilton . | |
| 1,623,630 | 4/1927 | Martin et al. . | |
| 1,637,893 | 8/1927 | Beskow . | |
| 1,641,353 | 9/1927 | Opper et al. | 219/222 X |
| 1,648,740 | 11/1927 | O'Malley | 132/32 A |
| 1,693,462 | 11/1928 | Polnaszek | 132/37 R |
| 1,694,672 | 12/1928 | Rogler | 219/225 |
| 2,031,377 | 2/1936 | Lindsay | 132/33 R |
| 2,046,672 | 7/1936 | Campion | 132/42 A |
| 2,377,877 | 6/1945 | Graham | 132/38 |
| 3,516,420 | 6/1970 | Porter . | |
| 3,859,497 | 1/1975 | McNair | 219/225 |
| 3,955,064 | 5/1976 | Demetrio et al. | 219/225 |
| 4,024,375 | 5/1977 | Olesen et al. | 219/225 |
| 4,027,684 | 6/1977 | Mueller | 132/40 |
| 4,034,201 | 7/1977 | Walter et al. | 219/222 |
| 4,151,850 | 5/1979 | Nathe et al. | 219/225 X |
| 4,164,952 | 8/1979 | Banks, Jr. | 132/37 R |
| 4,209,685 | 6/1980 | Walter et al. | 219/225 |
| 4,211,245 | 7/1980 | Coppola et al. | 132/40 |
| 4,214,597 | 7/1980 | Glassman | 132/40 X |
| 4,227,541 | 10/1980 | Satchell | 219/225 X |
| 4,261,375 | 4/1981 | Anderson | 132/32 R |
| 4,289,151 | 9/1981 | Pope | 132/37 R |
| 4,354,482 | 10/1982 | Beisecker | 132/37 R X |
| 4,426,567 | 1/1984 | Gugliotti | 219/225 |
| 4,464,562 | 8/1984 | Takimae | 219/225 |
| 4,479,047 | 10/1984 | Khaja et al. | 219/225 |

HAIR CURLING IRON FOR PROVIDING THREE-DIMENSIONAL Z-SHAPED CURLS

This invention relates to curling irons, and more particularly to curling irons having a heating tube which has a flattened oval or other non-round shape, and a shortened clamp.

BACKGROUND OF THE INVENTION

Many devices are available for curling a person's hair by wrapping a tuft of hair strands around a heated cylindrical tube, and transferring heat from the tube to the hair. Commercially available curling irons often include such a tube secured to a handle, and a heating element inside the tube. A clamp extends along substantially the entire length of the tube. The ends of the hair strands are grasped between the tube and the clamp and the hair strands are wrapped around the tube and over the clamp by twisting the iron. Heat which is transferred from the tube to the hair causes the hair to retain a spiral shaped curl when the clamp is released and the curling iron is removed. Heat is not transmitted efficiently to the outside layers of hair surrounding the tube, however, because the hair strands are wrapped over the clamp, and much of the hair is wrapped upon itself. Thus, heat transfer is reduced because the outer layers of hair are not in direct contact with the heating iron tube. Thus, there is a need for curling irons in which most of the hair is in substantially direct contact with the heating tube during the curling process.

Curling irons with round tubes form substantially round, spiral-shaped curls. Such irons are not used to produce other types of curls, including Z-shaped curls, which have recently grown in popularity, as well as other types. Thus, there is a need for curling irons which form Z-shaped curls and curls having other shapes.

Accordingly, one object of this invention is to provide new and improved curling irons for hair.

Another object is to provide new and improved curling irons which provide increased heat transfer to hair which is wrapped around the heated tube of the iron.

Still another object is to provide new and improved curling irons which create Z-shaped and other types of curls.

SUMMARY OF THE INVENTION

In keeping with one aspect of this invention, apparatus for curling hair includes a handle, a generally cylindrical tube secured to the handle, and means for heating the tube. The heating tube covers the heating element and has a generally flattened or oval shape. The outer surface of the tube includes relatively wide, spaced first and second surfaces which are joined at their edges by relatively narrow, rounded side surfaces. The shape of the tube forms the hair in Z-shaped curls. Other non-round shapes, such as rectangular and the like are also contemplated.

A clamp is hingedly secured to the curling iron. The clamp extends over only a portion of the tube adjacent the handle however, so that the ends of hair strands may be clamped near the handle, and the hair may be wrapped directly on the exposed portions of the tube in substantially direct contact with the tube.

The hinge of the clamp is located so that the clamp is substantially parallel to the tube when hair strands are between the clamp and the tube.

BRIEF DESCRIPTION OF THE DRAWINGS

The above-mentioned and other features of this invention and the manner of obtaining them will become more apparent and the invention itself will be best understood by reference to the following description, taken in conjunction with the accompanying drawings, in which.

DETAILED DESCRIPTION

Figure 1:
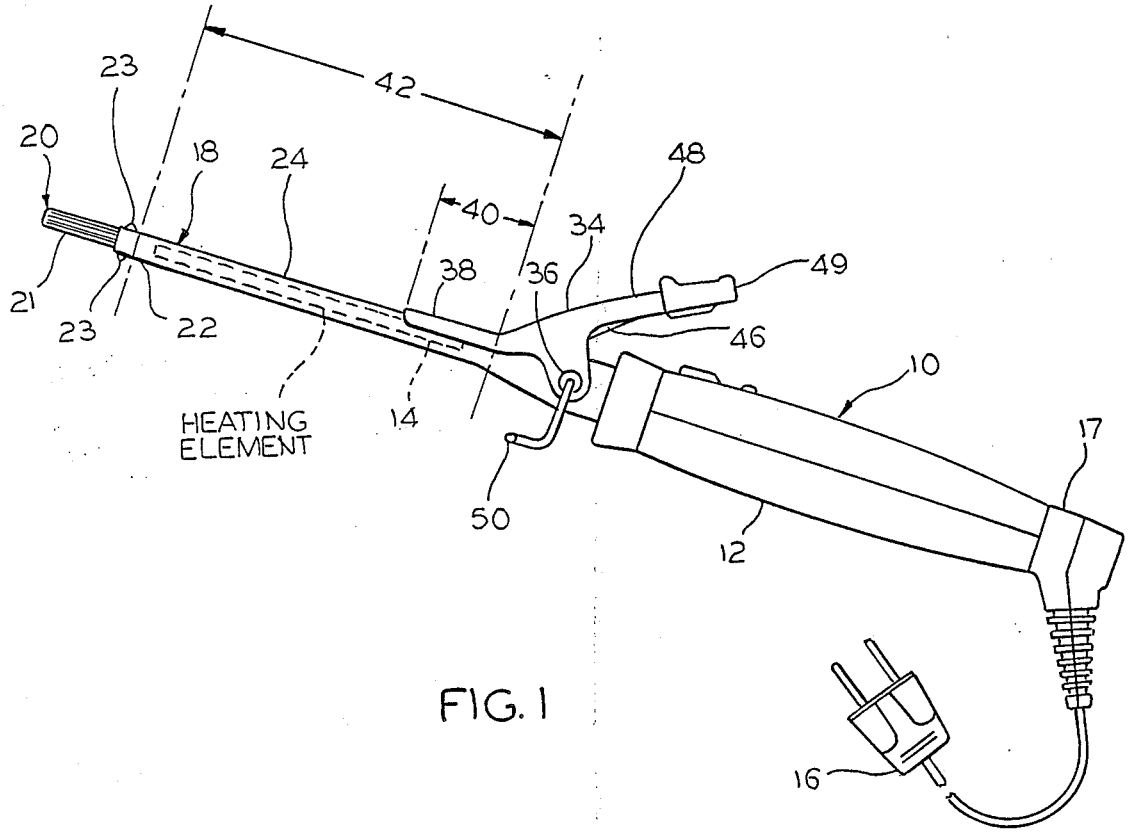
FIG. 1 is a side elevation view of a curling iron made in accordance with the invention.
Figure 2:
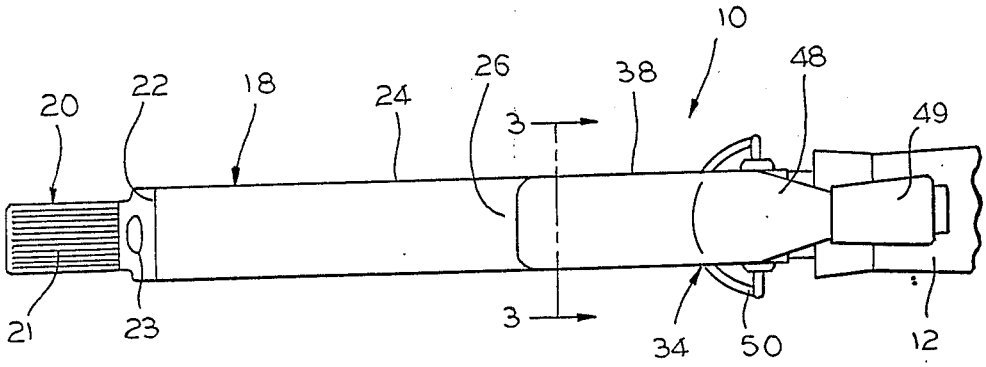
FIG. 2 is a top plan view of a portion of the apparatus of FIG. 1.

As seen in FIG. 1, a curling iron 10 includes a handle 12, a heating element 14 secured to the handle 12, and an electric cord 16 for providing energy to the heating element 14. The cord 16 may be secured to the handle 12 by a rotatable connection 17, so that the iron 10 may be rotated without unduly twisting the cord 16.

The handle 12 may be any suitable construction which provides sufficient thermal and electrical insulation from the heating element 14 so that the iron 10 can be held in an operator's hand for extended periods during use, without substantial discomfort. Suggested materials include heat resistant plastic. Added heat insulation may be realized by providing a second heat-resisant plastic piece (not shown) inside the handle 12. The second plastic piece may be installed between the heating element 14 and the handle piece 12 shown in FIG. 1.

The heating element 14 may be any suitable material and construction which provides sufficient heat to curl hair during operation. The element could be a resistance wire inside an electrically insulating sleeve, commonly called a rope heater, a resistance wire encapsulated in ceramic material, sometimes called a ceramic heater, a positive temperature coefficient thermistor, sometimes called a PTC heater, or a gas-powered element fueled by butane or the like. A nineteen watt heating element is considered sufficient for this purpose, although other power levels are contemplated. The power level should be sufficient to maintain a temperature of about 180° C. for professional users, and about 140°–160° C. for non-professional or home users. The element 14 may be heated by line voltage, batteries, gas or any other suitable energy source.

A heating tube or mandrel 18 in thermal contact with the heating element 14 is secured to the handle 12 and defines a hair curling mandrel about which a tuft of hair strands can be wound for curling. The tube 18 is preferably cylindrical near the handle 12 to provide strength in the tube 18 and a secure connection to the handle 12, and is some other shape in the part of the tube 18 which is a distance from the handle 12. The tube 18 is made of any suitable material, but is preferably metal, such as a copper alloy, which conducts heat well. An end piece 20 covers a distant end 22 of the tube 18. The end piece 20 is made of heat resistant plastic or the like so that the end piece 20 is cooler than the heated tube 18, and may be held between the fingers during operation. A reduced section 21 may be provided on end piece 20 for this purpose, if desired. The section 21 is reduced to prevent the fingers from inadvertently touching the heated tube 18. One or more lips 23 may also be provided on the end piece 20, if desired, to further prevent such undesired contacts, but some users will wish to easily slide hair over the end piece 20 without obstructions, and for this reason will prefer not to have the lips 23.

Figure 3:
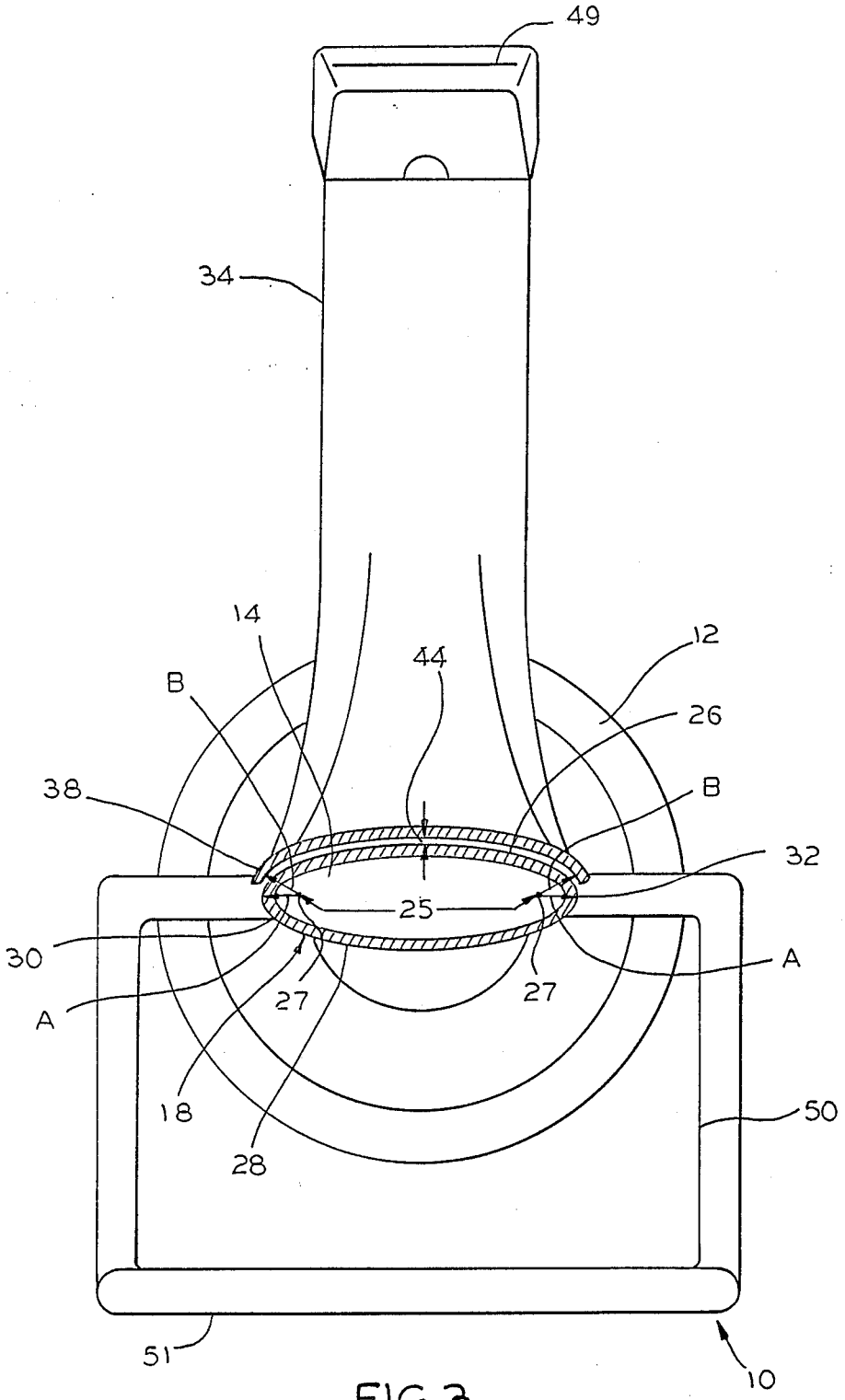
FIG. 3 is a sectional view of the apparatus of FIG. 1, taken along lines 3—3 in FIG. 2.
Figure 4:
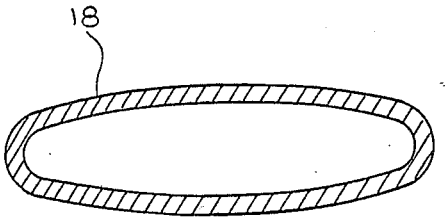
FIG. 4 is a sectional view of the heating tube of the curling iron of FIG. 1.

The tube 18 has a generally flattened oval shape, as seen in FIGS. 3 and 4, and includes an outer surface which has relatively wide top and bottom surfaces 26,28 and relatively narrow, rounded side surfaces 30,32 which join the top and bottom surfaces 26,28. The side surfaces 30,32 have a suitable radius A, such as about 0.09 inches.

Figure 6:
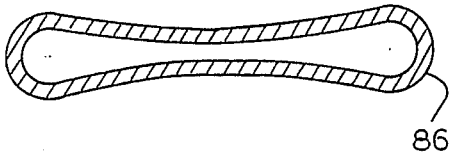
FIG. 6 is a sectional view of another alternate embodiment of the heating tube of the curling iron of FIG. 1.
Figure 9:
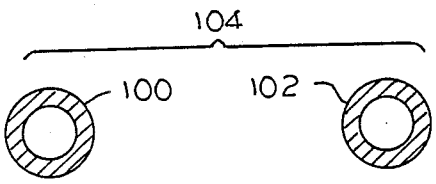
FIG. 9 is a sectional view of another alternate embodiment of the heating tube of the curling iron of FIG. 1.

The top and bottom surfaces 26,28 are curved outwardly in FIGS. 3 and 4, but could also curve inwardly, as seen in FIG. 6. Preferably, however, the distance 25 (FIG. 3) between the origins 27 of the radii A is greater than the radii A. For example, it is contemplated that the tube 18 could be made by joining two cylindrical rods together, or separating two rods by a selected distance, as seen in FIG. 9. The outside surface of the resulting heating tube would not be round, and the top and bottom surfaces would not be flat, but the distance between the origins of the radii of the two rods would be greater than the radii of the individual rods.

A clamp 34 (FIG. 1) is secured to the iron 10 adjacent the handle 12 by a hinge 36. The clamp 34 includes a clamping segment 38 which extends over a portion 40 of the tube 18. The portion 40 represents about 30% of the usable length 42 of the tube 18 in FIG. 1 which may be used for curling. If, for example, the total length 42 were about 5 inches, the portion 40 might be about 1½ inches. Other proportions up to about 50% are contemplated.

As seen in FIG. 3, the clamping segment 38 covers the top surface 26 and part of the side surfaces 30,32, and is preferably secured to the iron 10 so that the clamping segment 38 is substantially parallel to the tube 18 when there is a predetermined distance 44 between the clamping segment 38 and the tube 18. This may be accomplished by appropriately locating the hinge 36 and forming the clamp 38 as seen in FIG. 3. It is also contemplated that the clamping segment 38 could be placed over the side surface 30 or the side surface 32, if desired.

The clamping segment 38 has a radius B adjacent the side surfaces 30, 32 of the tube 18 which is equal to or larger than the radius A of the side surfaces 30,32. The radius B is typically somewhat larger than about 0.1 inches. It is contemplated that the distance 44 will be between about 0.010 and about 0.020 inches, which is about the thickness of a tuft of hair strands which might be placed beneath the clamping segment 38.

A spring 46 is provided which presses the clamping segment 38 towards the top surface 24 of the tube 18 in the absence of other forces on the clamp 34. The spring 46 may be any suitable configuration, and is preferably secured to the hinge 36 beneath the clamp 34, as shown in FIG. 1.

The clamp 34 also includes an actuator 48 which permits the operator to lift the clamping segment 38 of the clamp 34 away from the tube 18 when desired. The actuator 48 includes a plastic end 49, and should be long enough to provide sufficient leverage so that the clamp 34 may be easily operated, and so that the end 49 does not become excessively hot during operation.

A stand 50 may be attached to the iron 10 by securing it to the hinge 36, if desired, as seen in FIGS. 1 and 3. The stand 50 may be secured for moveable operation so that it may be located out of the way during operation, and placed in a proper position when the operator wishes to set the iron 10 on a table or the like. The stand 50 includes a bar 51 which is wide enough to prevent the iron 10 from rolling in an undesired manner when it is placed on the stand 50. In addition, the stand 50 is secured to the iron 10 to one side of the center of gravity of the iron 10, so that the handle 12 is forced down when the iron 10 is placed on a table or the like. This prevents the hot tube 18 from touching the table.

Figure 5:
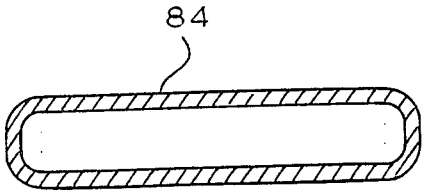
FIG. 5 is a sectional view of an alternate embodiment of the heating tube of the curling iron of FIG. 1.

Additional alternate embodiments of the tube 18 are shown in FIGS. 5, 6, 7, 8 and 9. Each of those embodiments produces curls which are not round or spiral like the curls created by conventional curling irons. For example, the tube 84 of FIG. 5 is rectangular and will produce Z-shaped rectangular curls. Curls produced by a tube 86 in FIG. 6 would be similar to those created by the tube 18 in FIG. 1.

Figure 7:
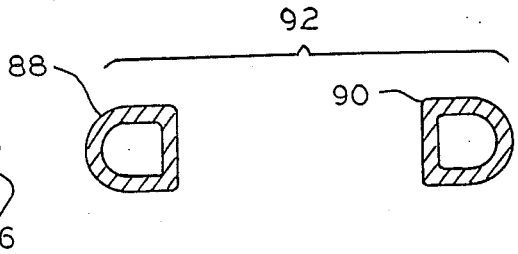
FIG. 7 is a sectional view of another alternate embodiment of the heating tube of the curling iron of FIG. 1.
Figure 8:
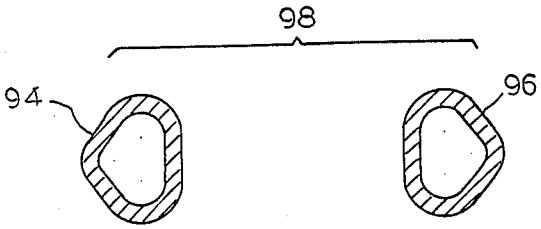
FIG. 8 is a sectional view of another alternate embodiment of the heating tube of the curling iron of FIG. 1.

It is contemplated that two tubes could be used to create curls by using the tube configurations shown in FIGS. 7, 8 and 9. FIG. 7 shows two D-shaped cross-section tubes 88, 90 separated by a space 92. FIG. 8 shows two triangular tubes 94, 96 separated by a space 98, and FIG. 9 shows two cylindrical cross-section tubes 100, 102 separated by a space 104. While it is possible that hair could be woven between the pairs of tubes, it is anticipated that hair would be wound around the outside of the tubes in curls.

The tubes of FIGS. 1–6 and pairs of tubes in FIGS. 7–9 do not have a constant radius, and do not produce curls which are round. The tubes have a combination of straight areas, or areas having a relatively large radius, and curved areas having a relatively small radius. In this manner, curls having various shapes which are not circular are created.

Figure 10:
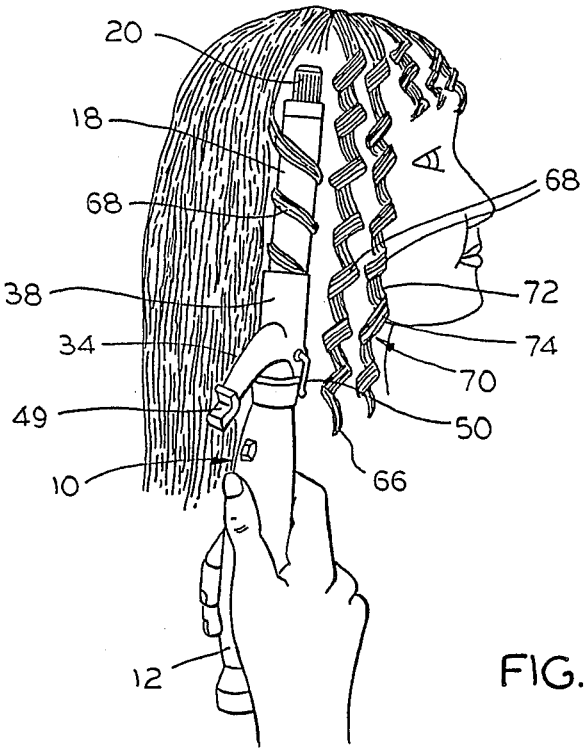
FIG. 10 is an elevational view of the apparatus of FIG. 1 in use.

During operation, the iron 10 (FIG. 1) is connected to a power source and the heating element 14 is heated to a suitable temperature. The tube 18 is heated through thermal transfer from the element 14. The stand 50 is pushed away from the tube 18 during operation, as shown in FIG. 10.

The operator raises the clamping segment 38 of the clamp 34 by pushing the actuator end 49 down while holding the handle 12. The ends 66 (FIG. 10) of a tuft of hair strands 68 are placed between the tube 18 and the clamping segment 38. Then the actuator end 49 is released. The spring 46 forces the clamping segment 38 against the hair strands 68, grasping the ends 66 between the tube 18 and the clamping segment 38.

After the actuator end 49 is released and the ends 66 are held in place, the rest of the hair strands 68 are wrapped around the tube 18, preferably by twirling the tube 18, so that substantially the entire length of the strands 68 touches the tube 18, without overlapping, as shown in FIG. 4. The iron may be twirled by placing the end 20 between the fingers, if desired. By twirling the tube in this manner, the hair strands are not twisted over each other with respect to the mandrel. Such twisting would create the appearance of twine. Twirling the tube in the manner suggested creates the untwisted appearance seen in FIGS. 10, 11 and 12.

Figure 11:
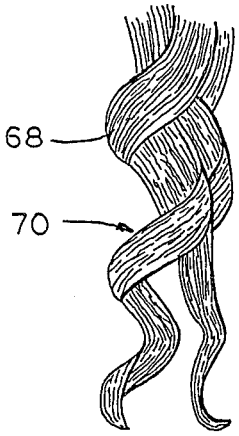
FIG. 11 is a perspective view of Z-shaped curls made in accordance with this invention.

After an acceptable period of time, the strands 68 are released by raising the actuator 48 and removing the iron 10. The strands 68 maintain generally Z-shaped curls 70 having a plurality of relatively straight lengths 72 separated by curves 74. The curves 74 create an angle between adjacent lengths 72 which is greater than 90 degrees, as seen in FIGS. 10, 11 and 12.

The curls may be combed out to create a variety of interesting appearances. The curls shown in FIG. 10 and the curls shown in FIG. 12 are in substantially the form in which they were curled around the tube 18. The curls in FIG. 11 have been combed out to increase the distance between adjacent curls.

Figure 12:
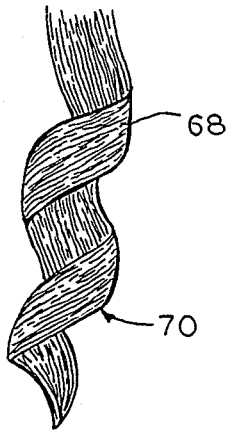
FIG. 12 is another perspective view of Z-shaped curls made in accordance with this invention.

By helically wrapping the hair around the tube 18 without overlapping, the Z-shaped curls produced by the iron 10 generally coil in a three dimensional spiral, as shown in FIGS. 10 and 12. If the curls are combed out, as in FIG. 11, three-dimensional Z-shaped curls which contain fewer strands of hair are created.

The many advantages of this invention are now apparent. Heat transfer to hair strands which are wrapped around the heated tube of the iron is increased because substantially the entire length of the strands are in contact with the heated tube. In addition, the iron creates Z-shaped and other shaped curls.

While in the foregoing description of the invention various features of the invention have been described in considerable detail, it is to be understood that the description is not a limitation on the scope of the claims which follow.

What is claimed is:

1. Apparatus for curling hair comprising:

a handle, a single elongated thermally conductive heating mandrel secured to an end of said handle in substantially axial alignment therewith, said heating mandrel being in heat exchange relationship with a heating element therein, said heating mandrel having sufficient length so that hair strands may be helically wrapped in a plurality of turns around said mandrel without overlapping, said mandrel having two wide similar opposing surfaces joined by two convex opposing surfaces which are relatively narrow with respect to said wide surfaces, said convex surfaces each having a radius of about 0.09 inch, and means for clamping the ends of hair strands against said mandrel before said strands are helically wrapped around said mandrel, said hair clamping means including a clamping surface mounted at said handle end of said mandrel which extends across at least a portion of one of said relatively wide surfaces of said heating mandrel while exposing substantially all of said convex surfaces to direct contact with said hair strands, means for pressing said clamping surface towards said mandrel, and means for moving said clamping surface away from said mandrel, whereby the apparatus may be turned to helically wind said hair strands around said mandrel, without twisting said hair strands around each other or overlapping the turns of said hair strands on said mandrel, to create three-dimensional Z-shaped curls having a plurality of substantially straight lengths joined by sharp curves.

2. The apparatus of claim 1 wherein said wide surfaces are substantially flat.

3. The apparatus of claim 1 wherein said wide surfaces are convex, said heating mandrel having a transverse cross-section the general shape of an oval.

4. The apparatus of claim 1 wherein said clamping surface extends along less than about 50 percent of the usable length of said heating mandrel.

5. The apparatus of claim 1 wherein said clamping surface extends over about 30 percent of said usable length of said heating mandrel.

6. The apparatus of claim 1 comprising a heat resistant end piece secured to the end of said heating mandrel which is opposite to said end which is secured to said handle, said end piece having a first portion adjacent to said mandrel which has substantially the same transverse cross-section as said mandrel, and an outer portion secured to said first portion, said outer portion having a transverse cross-section which is about equal to said mandrel cross-section between said wide opposing surfaces, and is narrower than said mandrel cross-section between said convex surfaces, whereby the fingers are prevented from inadvertently touching said heating mandrel, without obstructing hair from sliding over said end piece as the hair is removed from said heating mandrel.

* * * * *

UNITED STATES PATENT AND TRADEMARK OFFICE

CERTIFICATE OF CORRECTION

PATENT NO. : 4,866,248

DATED : September 12, 1989

INVENTOR(S) : Altamore et al.

It is certified that error appears in the above-identified patent and that said Letters Patent is hereby corrected as shown below:

On the title page, item [54] and column 1, line 1, in the Title, change "PROVIDING" to --PRODUCING-- and in item [75] amend the inventive entity to add --Gregory S. Wahl, Sterling, Illinois--.

Column 5, line 8, change "4" to --10--.

Signed and Sealed this

Sixteenth Day of April, 1991

*Attest:*

*Attesting Officer*

HARRY F. MANBECK, JR.

*Commissioner of Patents and Trademarks*